US008552938B2

(12) United States Patent
Lee et al.

(10) Patent No.: US 8,552,938 B2
(45) Date of Patent: Oct. 8, 2013

(54) DISPLAY DEVICE AND METHOD OF DRIVING THE SAME

(71) Applicant: Samsung Display Co., Ltd., Yongin (KR)

(72) Inventors: Baek-Woon Lee, Yongin-si (KR); Doo-Hyung Woo, Anyang-si (KR); Kyong-Tae Park, Suwon-si (KR); Ji-Hye Eom, Suwon-si (KR); Seong-Il Park, Seoul (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 0 days.

(21) Appl. No.: 13/737,047

(22) Filed: Jan. 9, 2013

(65) Prior Publication Data

US 2013/0127693 A1 May 23, 2013

Related U.S. Application Data

(63) Continuation of application No. 12/424,732, filed on Apr. 16, 2009.

(30) Foreign Application Priority Data

Dec. 5, 2008 (KR) ..... 10-2008-0123601

(51) Int. Cl.
*G09G 3/30* (2006.01)

(52) U.S. Cl.
USPC ..... 345/76; 315/169.3

(58) Field of Classification Search
USPC ..... 345/44–46, 76–81, 94, 95, 98–100, 345/204–214; 315/169.1, 169.3
See application file for complete search history.

(56) References Cited

U.S. PATENT DOCUMENTS

| | | | | |
|---|---|---|---|---|
| 7,202,606 | B2 * | 4/2007 | Eom et al. | 315/169.3 |
| 7,649,515 | B2 * | 1/2010 | Ozawa et al. | 345/82 |
| 7,688,292 | B2 * | 3/2010 | Park et al. | 345/82 |
| 7,978,156 | B2 * | 7/2011 | Kim | 345/76 |
| 8,111,219 | B2 * | 2/2012 | Kim | 345/76 |
| 8,188,940 | B2 * | 5/2012 | Kim | 345/76 |
| 8,310,469 | B2 * | 11/2012 | Park et al. | 345/204 |
| 8,325,118 | B2 * | 12/2012 | Senda | 345/82 |
| 2003/0067424 | A1 * | 4/2003 | Akimoto et al. | 345/55 |
| 2003/0112208 | A1 * | 6/2003 | Okabe et al. | 345/82 |
| 2004/0100202 | A1 * | 5/2004 | Koyama | 315/169.3 |
| 2005/0068271 | A1 * | 3/2005 | Lo | 345/76 |
| 2005/0110730 | A1 * | 5/2005 | Kim et al. | 345/82 |
| 2005/0200575 | A1 * | 9/2005 | Kim et al. | 345/76 |
| 2005/0206591 | A1 * | 9/2005 | Wang et al. | 345/76 |

(Continued)

FOREIGN PATENT DOCUMENTS

| | | |
|---|---|---|
| JP | 2004-078210 | 3/2004 |
| JP | 2004-138773 | 5/2004 |

(Continued)

*Primary Examiner* — Dmitriy Bolotin

(74) *Attorney, Agent, or Firm* — F. Chau & Associates, LLC

(57) ABSTRACT

A display device and a method of driving the same in which moving image blurring is prevented and a contrast ratio is enhanced by providing a light-emitting element, switching transistors, and a driving transistor with driving signals that include specific voltages at predetermined times, so that the light-emitting element does not emit light for an entire frame and the light output is not influenced by a threshold voltage of the driving transistor.

9 Claims, 18 Drawing Sheets

(56) References Cited

U.S. PATENT DOCUMENTS

| | | | | |
|---|---|---|---|---|
| 2005/0212446 | A1* | 9/2005 | Eom | 315/169.3 |
| 2005/0243036 | A1* | 11/2005 | Ikeda | 345/76 |
| 2006/0022605 | A1* | 2/2006 | Ha et al. | 315/169.3 |
| 2006/0170625 | A1* | 8/2006 | Kim | 345/76 |
| 2006/0227083 | A1* | 10/2006 | Miyazawa | 345/76 |
| 2007/0040772 | A1* | 2/2007 | Kim | 345/76 |
| 2007/0124633 | A1* | 5/2007 | Kim | 714/726 |
| 2007/0229411 | A1* | 10/2007 | Choi | 345/76 |
| 2008/0158205 | A1* | 7/2008 | Park et al. | 345/204 |
| 2008/0170009 | A1* | 7/2008 | Eom | 345/76 |
| 2009/0207158 | A1* | 8/2009 | Park et al. | 345/211 |

FOREIGN PATENT DOCUMENTS

| | | |
|---|---|---|
| JP | 2004-341353 | 12/2004 |
| JP | 2005-244956 | 9/2005 |
| JP | 2007-219176 | 8/2007 |
| JP | 2008-040326 | 2/2008 |
| KR | 1020040034439 | 4/2004 |
| KR | 1020060114471 | 11/2006 |
| KR | 100722124 | 5/2007 |
| KR | 1020070082505 | 8/2007 |
| KR | 100782455 | 11/2007 |
| KR | 100833754 | 5/2008 |
| KR | 100834065 | 5/2008 |

* cited by examiner

DISPLAY DEVICE AND METHOD OF DRIVING THE SAME

CROSS-REFERENCE TO RELATED APPLICATION

This application is a divisional application of co-pending U.S. application Ser. No. 12/424,732 filed Apr. 16, 2009, which claims priority to and the benefit of Korean Patent Application No. 10-2008-0123601 filed in the Korean Intellectual Property Office on Dec. 5, 2008, the disclosures of which are each hereby incorporated by reference herein in their entireties.

BACKGROUND (a) Technical Field

The present disclosure relates to a display device and a method of driving the same. More particularly, the present disclosure relates to an organic light emitting device and a method of driving the same.

(b) Discussion of Related Art

A pixel of an organic light emitting device includes an organic light emitting element, and a thin film transistor (TFT) with a capacitor that drives the same.

The TFT is classified into a polysilicon TFT or an amorphous silicon TFT, according to the kind of active layer that is employed.

Because amorphous silicon is deposited at a low temperature and forms a thin film, the amorphous silicon is generally used for a semiconductor layer of a switching element of a display device that uses a low melting point glass mainly as a substrate. There is a difficulty with the amorphous silicon TFT when increasing an area of a display element, however, due to low electron mobility. Furthermore, because the amorphous silicon TFT continuously applies a DC voltage to the control terminal, a threshold voltage is varied and the amorphous silicon TFT may be thus degraded. This becomes a major factor that shortens the lifetime of the organic light emitting device.

Therefore, application of a polysilicon TFT that has high electron mobility, good high frequency operation characteristics, and a low leakage current is desirable. More specifically, by using a low temperature polycrystalline silicon (LTPS) backplane, the lifetime problem is considerately resolved. A laser shot mark due to laser crystallization, however, causes a deviation in a threshold voltage of the driving transistors within one panel, and thus screen uniformity is deteriorated.

In order to resolve this problem, the organic light emitting device may be provided with a compensation circuit. Such a compensation circuit includes a plurality of TFTs. As the number of TFTs that are included in the compensation circuit increases, the aperture ratio of a pixel is deteriorated, and a burden on a leakage current or a failure of the TFT increases.

A hole type of flat panel display device, such as an organic light emitting device, displays a fixed image for a predetermined time period, for example for one frame, regardless of whether it is a still image or a motion picture. For example, when displaying an object that continuously moves, the object stays at a specific position for one frame and stays at the next position to which the object moves after a time period of one frame at the next frame, and thus motion of the object is discretely displayed. Because a time period of one frame is a time period in which an afterimage is sustained, even if a motion of the object is displayed in this way, the motion of the object appears to be continuous.

When viewing a continuously moving object on a screen, however, because a line of sight of a person continuously moves along a direction of motion of the object, the line of sight of the person collides with a discrete display method of the display device and, thus, a blurring phenomenon occurs. For example, if it is assumed that the display device displays an object that stays at a position A at a first frame and at a position B at a second frame, at the first frame, a line of sight of a person moves from the position A to the position B along an estimated movement path of the object. The object is not actually displayed, however, at an intermediate position between the positions A and B.

Finally, because luminance that is recognized by a person for the first frame is an integrated value of luminance of pixels existing at a path between the positions A and B, that is, an average value between the luminance of an object and the luminance of a background, an object is blurredly viewed.

Because a degree in which an object is blurredly viewed in a hole type display device is proportional to a time period in which the display device sustains the display, a so-called impulse driving method in which an image is displayed only for a partial time period within one frame and a black color is displayed for the remaining time period has been suggested. In such an impulse driving method, however, if unintended light emission occurs for the period during which a black color is displayed, the contrast ratio of an organic light emitting device is reduced.

The above information disclosed in this Background section is only for enhancement of understanding of the background of the invention and therefore it may contain information that does not form the prior art that is already known in this country to a person of ordinary skill in the art.

SUMMARY OF THE INVENTION

Exemplary embodiments of the present invention have been made in an effort to provide a display device and a method of driving the same having advantages of reducing a blurring phenomenon of an image of an organic light emitting device, increasing the aperture ratio by decreasing the number of TFTs that are included in a compensation circuit, and reducing a burden on a leakage current or a failure of the TFT. Exemplary embodiments of the present invention have been made in an effort to further provide a display device and a method of driving the same having advantages of increasing the contrast ratio of the display device by preventing undesirable light emission while driving an organic light emitting device.

An exemplary embodiment of the present invention provides a display device including: a light-emitting element; a first capacitor that is connected between first and second contact points; a driving transistor that has an output terminal, an input terminal that is connected to a first voltage, and a control terminal that is connected to the second contact point; a first switching transistor that is controlled by a first scanning signal and that is connected between a data voltage and the first contact point; a second switching transistor that is controlled by a first scanning signal and that is connected between a second voltage and the first contact point; a third switching transistor that is controlled by the first scanning signal and that is connected between the second contact point and the output terminal of the driving transistor; and a fourth switching transistor that is controlled by a second scanning signal and that is connected between the light-emitting element and the output terminal of the driving transistor.

The first scanning signal may consist of a high voltage and a low voltage, and the second scanning signal may consist of the high voltage, the low voltage, and an intermediate voltage that has a value between the high voltage and the low voltage.

The display device may further include a first scanning driver that generates the first scanning signal and a second scanning driver that generates the second scanning signal.

The second scanning driver may include: a multiplexer that selects and outputs one of the high voltage and the intermediate voltage according to a first input signal; and an inverter that outputs one of an output signal of the multiplexer or the low voltage as the second scanning signal according to a second input signal.

The first input signal may be the same as the first scanning signal.

The fourth switching transistor may be turned on and the light-emitting element does not emit light when the second control signal has a value of the intermediate voltage.

At first to fifth periods that are sequentially connected, for the first period, the first, third, and fourth switching transistors may be turned off and the second switching transistor may be turned on; for the second period, the first, third, and fourth switching transistors may be turned on and the second switching transistor may be turned off; for the third period, the first and third switching transistors may be turned on and the second and fourth switching transistors may be turned off; for the fourth period, the first, third, and fourth switching transistors may be turned off and the second switching transistor may be turned on; and for the fifth period, the first and third switching transistors may be turned off and the second and fourth switching transistors may be turned on.

The light-emitting element may discontinue light emission for the first, second, third, and fourth periods, and emit light for the fifth period.

The sum of the first to fifth periods may be one frame.

The fifth period may be a half frame.

The first, third, and fourth switching transistors may each be an n-channel electric field effect transistor, and the second switching transistor and the driving transistor may each be a p-channel electric field effect transistor.

The display device may further include a fifth switching transistor that is connected between the second voltage and the second contact point.

The first, third, and fifth switching transistors may each be an n-channel electric field effect transistor, and the second switching transistor, the fourth switching transistor, and the driving transistor may each be a p-channel electric field effect transistor.

The display device may further include a fifth switching transistor that is connected between the third voltage and the second contact point.

The third voltage may be a pull-down voltage.

The first, third, and fifth switching transistors may each be an n-channel electric field effect transistor, and the second switching transistor, the fourth switching transistor, and the driving transistor may each be a p-channel electric field effect transistor.

An exemplary embodiment of the present invention provides a method of driving a display device including a light-emitting element, a capacitor that is connected between first and second contact points, and a driving transistor that has an input terminal, an output terminal, and a control terminal that is connected to the second contact point, the method including: disconnecting a connection between the output terminal of the driving transistor and the light-emitting element; connecting a data voltage to the first contact point, connecting the second contact point to the output terminal of the driving transistor, and connecting the output terminal of the driving transistor to the light-emitting element; disconnecting a connection between the output terminal of the driving transistor and the light-emitting element, in a state where the data voltage is connected to the first contact point and the second contact point is connected to the output terminal of the driving transistor; and disconnecting a connection between the first contact point and the data voltage, connecting a sustain voltage to the first contact point, and connecting the light-emitting element to the output terminal of the driving transistor.

At the connecting of a data voltage to the first contact point, the connecting of the second contact point to the output terminal of the driving transistor, and the connecting of the output terminal of the driving transistor to the light-emitting element, the light-emitting element may not emit light.

The disconnecting of a connection between the first contact point and the data voltage, the connecting of a sustain voltage to the first contact point, and the connecting of the light-emitting element to the output terminal of the driving transistor may be performed for a half frame.

An exemplary embodiment of the present invention provides a display device including: a light-emitting element; a first capacitor that is connected between first and second contact points; a driving transistor that has an output terminal, an input terminal that is connected to a first voltage, and a control terminal that is connected to the second contact point; a first switching transistor that is controlled by a first scanning signal and that is connected between a data voltage and the first contact point; a second switching transistor that is controlled by the first scanning signal and that is connected between a second voltage and the first contact point; a third switching transistor that is controlled by a second scanning signal and that is connected between the second contact point and the output terminal of the driving transistor; a fourth switching transistor that is controlled by a third scanning signal and that is connected between the light-emitting element and the output terminal of the driving transistor; and a fifth switching transistor that is controlled by a fourth scanning signal and that is connected between the second voltage and the second contact point.

The first to fourth scanning signals may consist of a high voltage and a low voltage, and periods in which each of the second and fourth scanning signals is a high voltage may not overlap.

High voltages of each of the second and fourth scanning signals may be sustained for more than half a horizontal period.

The high voltage of the first scanning signal may be sustained for two horizontal periods.

A period in which the first scanning signal is a high voltage may overlap with each of the periods in which the second and fourth scanning signals are a high voltage.

The high voltage of the fourth scanning signal may be sustained for two horizontal periods.

A period in which the third scanning signal is a high voltage may be longer than a period in which the first, second, and fourth scanning signals are a high voltage.

The second voltage may have a lower value than the first voltage.

An exemplary embodiment of the present invention provides a method of driving a display device including a light-emitting element, a capacitor that is connected between first and second contact points, and a driving transistor that has an input terminal, an output terminal, and a control terminal that is connected to the second contact point, the method including: disconnecting a connection between the output terminal of the driving transistor and the light-emitting element; connecting a sustain voltage to the first and second contact points; disconnecting a sustain voltage that is connected to the first and second contact points, connecting a data voltage to the first contact point, and connecting the second contact point to the output terminal of the driving transistor; disconnecting a connection between the first contact point and the data voltage, disconnecting a connection between the second contact point and the output terminal of the driving transistor, and reconnecting the first contact point and the sustain voltage; and connecting the light-emitting element to the output terminal of the driving transistor.

The connecting of a data voltage to the first contact point and the connecting of the second contact point to the output terminal of the driving transistor may include connecting the second contact point to the output terminal of the driving transistor when a predetermined time period has elapsed after the data voltage is connected to the first contact point.

The connecting of a sustain voltage to the first and second contact points may be performed for more than half a horizontal period.

The connecting of the second contact point to the output terminal of the driving transistor may be performed for more than half a horizontal period.

The connecting of a data voltage to the first contact point may be performed for two horizontal periods.

The connecting of a sustain voltage to the first and second contact points may be performed for two horizontal periods.

The sustain voltage may be lower than the driving voltage.

An exemplary embodiment of the present invention provides a method of driving a display device including a light-emitting element, a capacitor that is connected between first and second contact points, and a driving transistor that has an input terminal, an output terminal, and a control terminal that is connected to the second contact point, the method including: disconnecting a connection between the output terminal of the driving transistor and the light-emitting element; connecting a pull-down voltage to the second contact point; disconnecting the pull-down voltage that is connected to the second contact point, connecting a data voltage to the first contact point, and connecting the second contact point to the output terminal of the driving transistor; disconnecting a connection between the first contact point and the data voltage, disconnecting a connection between the second contact point and the output terminal of the driving transistor, and connecting the first contact point and the sustain voltage; and connecting the light-emitting element to the output terminal of the driving transistor.

The connecting of a data voltage to the first contact point and the connecting of the second contact point to the output terminal of the driving transistor may include connecting the second contact point to the output terminal of the driving transistor when a predetermined time period has elapsed after the data voltage is connected to the first contact point.

The connecting of a pull-down voltage to the second contact point may be performed for more than half a horizontal period.

The connecting of the second contact point to the output terminal of the driving transistor may be performed for more than half a horizontal period.

The sustain voltage and the pull-down voltage may be lower than the driving voltage.

Therefore, a blurring phenomenon of an image of the organic light emitting device can be reduced, and a deviation of a threshold voltage can be compensated. In addition, by sustaining reliability of each TFT that is included in the organic light emitting device, display quality can be improved.

DETAILED DESCRIPTION OF EXEMPLARY EMBODIMENTS

The present invention will be described more fully hereinafter with reference to the accompanying drawings, in which exemplary embodiments of the invention are shown. As those of ordinary skill in the art would realize, the described exemplary embodiments may be modified in various different ways, all without departing from the spirit or scope of the present invention.

First, an organic light emitting device according to an exemplary embodiment of the present invention will be described with reference to FIGS. 1 and 2.

Figure 1:
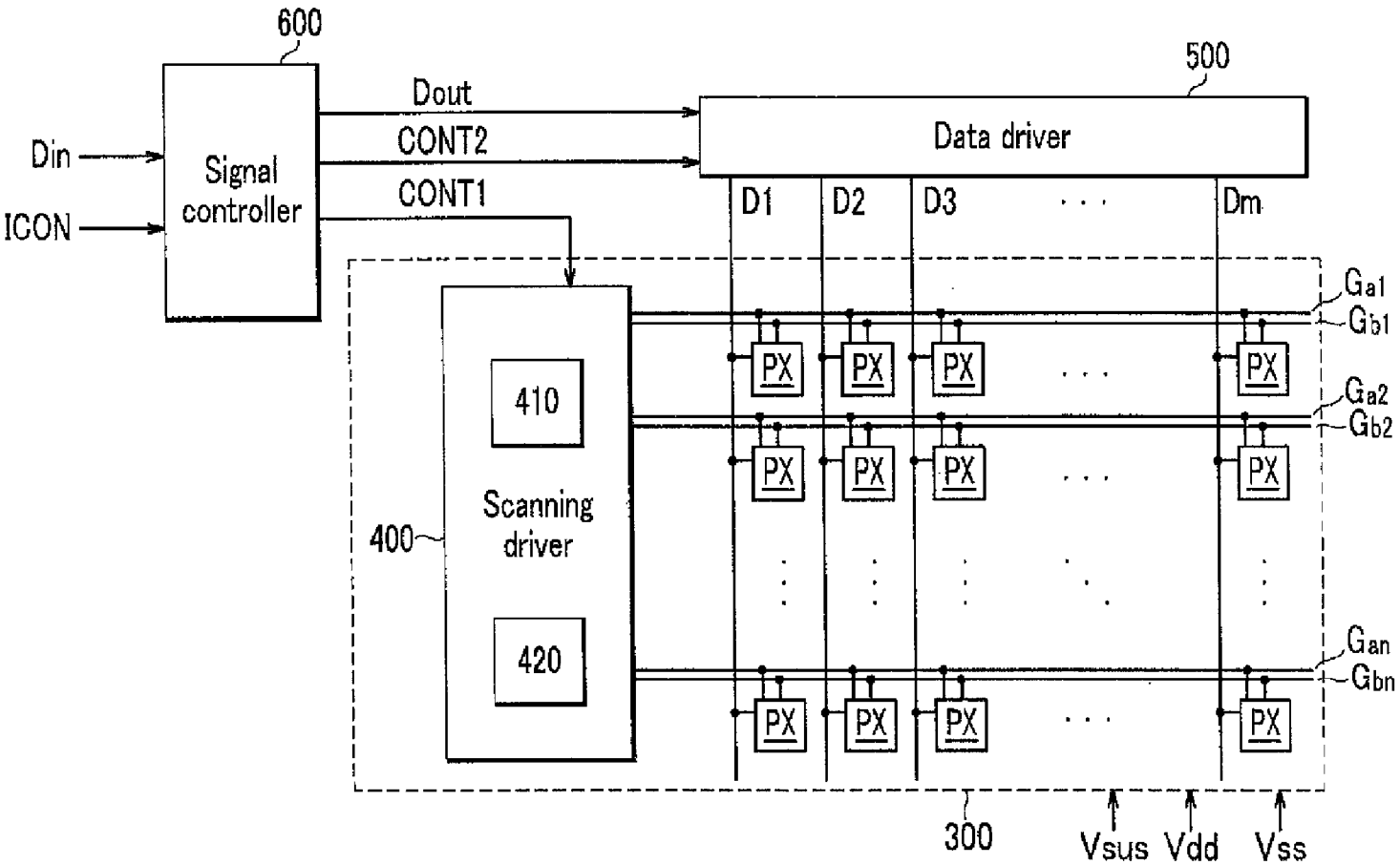
FIG. 1 is a block diagram of an organic light emitting device according to an exemplary embodiment of the present invention.
Figure 2:
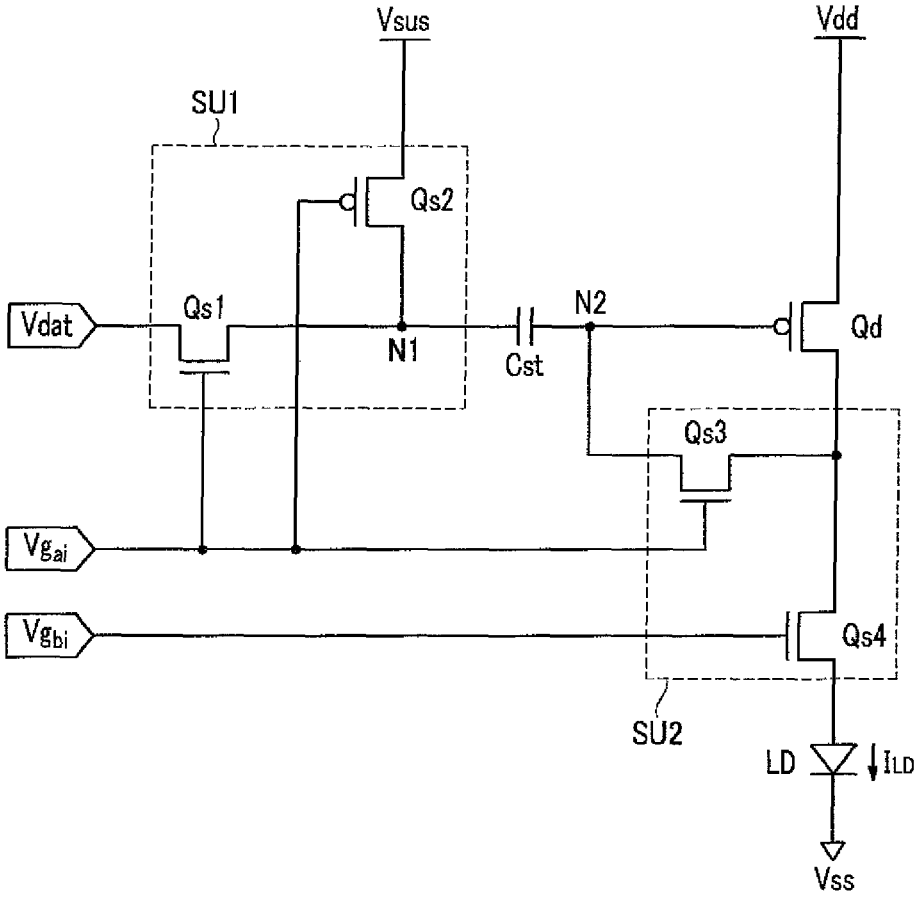
FIG. 2 is an equivalent circuit diagram of one pixel in an organic light emitting device according to an exemplary embodiment of the present invention.

FIG. 1 is a block diagram of an organic light emitting device according to an exemplary embodiment of the present invention, and FIG. 2 is an equivalent circuit diagram of one pixel in an organic light emitting device according to an exemplary embodiment of the present invention.

Referring to FIG. 1, the organic light emitting device includes a display panel 300, a scanning driver 400, a data driver 500, and a signal controller 600.

The display panel 300 includes a plurality of signal lines $G_{a1}$-$G_{bn}$ and $D_1$-$D_m$, a plurality of voltage lines (not shown), and a plurality of pixels PX that are connected thereto and that are arranged in approximately a matrix form.

The signal lines $G_{a1}$-$G_{bn}$ and $D_1$-$D_m$ include a plurality of scanning signal lines $G_{a1}$-$G_{bn}$ that transfer a scanning signal and a plurality of data lines $D_1$-$D_m$ that transfer a data signal. The scanning signal lines $G_{a1}$-$G_{bn}$ include first scanning signal lines $G_{a1}, G_{a2}, \ldots, G_{an}$ that transfer a first scanning signal Vgai (i=1, . . . , N), and second scanning signal lines $G_{b1}$, $G_{b2}, \ldots, G_{bn}$ that transfer a second scanning signal Vgbi (i=1, . . . , N). The scanning signal lines $G_{a1}$-$G_{bn}$ extend in approximately a row direction and are substantially parallel to each other, and the data lines $D_1$-$D_m$ extend in approximately a column direction and are substantially parallel to each other.

The voltage line includes a driving voltage line (not shown) that transfers a driving voltage and a sustain voltage line (not shown) that transfers a sustain voltage.

As shown in FIG. 2, each pixel PX includes an organic light emitting element LD, a driving transistor Qd, a capacitor Cst, and first, second, third, and fourth switching transistors Qs1, Qs2, Qs3, and Qs4.

The driving transistor Qd has an output terminal, an input terminal, and a control terminal. The control terminal of the driving transistor Qd is connected to the capacitor Cst at a contact point N2, the input terminal thereof is connected to a driving voltage Vdd, and the output terminal thereof is connected to the fourth switching transistor Qs4.

One end of the capacitor Cst is connected to the driving transistor Qd at the contact point N2 and is connected to the first and second switching transistors Qs1 and Qs2 at a contact point N1.

The first to fourth switching transistors Qs1, Qs2, Qs3, and Qs4 may be combined into two switching units SU1 and SU2.

The switching unit SU1 selects one of a data voltage Vdat and a sustain voltage Vsus in response to the first scanning signal Vgai to be connected to the contact point N1, and includes the first and second switching transistors Qs1 and Qs2. The first switching transistor Qs1 operates in response to the first scanning signal Vgai and is connected between the contact point N1 and the data voltage Vdat. The second switching transistor Qs2 also operates in response to the first scanning signal Vgai and is connected between the contact point N1 and the sustain voltage Vsus.

The switching unit SU2 selects one of the contact point N2 and the organic light emitting element LD in response to the first and second scanning signals Vgai and Vgbi to be connected to the output terminal of the driving transistor Qd, and includes the third and fourth switching transistors Qs3 and Qs4. The third switching transistor Qs3 operates in response to the first scanning signal Vgai and is connected between the output terminal of the driving transistor Qd and the contact point N2, and the fourth switching transistor Qs4 operates in response to the second scanning signal Vgbi and is connected between the output terminal of the driving transistor Qd and the organic light emitting element LD.

The first, third, and fourth switching transistors Qs1, Qs3, and Qs4 are each an n-channel electric field effect transistor, and the second switching transistor Qs2 and the driving transistor Qd are each a p-channel electric field effect transistor. The electric field effect transistor includes, for example, a TFT, and they may be formed of polysilicon or amorphous silicon. Channel types of the switching transistors Qs1, Qs2, Qs3, and Q4 and the driving transistor Qd may be reversed. In this case, waveforms of signals for driving them may also be inverted.

An anode and a cathode of the organic light emitting element LD are connected to the fourth switching transistor Qs4 and a common voltage Vss, respectively. The organic light emitting element LD emits light with different intensities according to the magnitude of a current $I_{LD}$ that is supplied by the driving transistor Qd through the fourth switching transistor Qs4, thereby displaying an image, and the magnitude of the current $I_{LD}$ depends on the magnitude of a voltage between the control terminal and the input terminal of the driving transistor Qd.

Referring again to FIG. 1, the scanning driver 400 is connected to the scanning signal lines $G_{1a}$-$G_{bn}$ of the display panel 300 and applies scanning signals to each of the scanning signal lines $G_{1a}$-$G_{bn}$. The scanning driver 400 includes first and second scanning drivers 410 and 470, the first scanning driver 410 applies the first scanning signal Vgai to the first scanning signal lines $G_{a1}$-$G_{an}$, and the second scanning driver 420 applies the second scanning signal Vgbi to the second scanning signal lines $G_{b1}$-$G_{bn}$. The first scanning signal Vgai consists of a high voltage Von and a low voltage Voff, and the second scanning signal Vgbi consists of the high voltage Von, the low voltage Voff, and an intermediate voltage Vm.

The high voltage Von allows the first, third, and fourth switching transistors Qs1, Qs3, and Qs4 to be turned on, and allows the second switching transistor Qs2 to be turned off, and the low voltage Voff allows the first, third, and fourth switching transistors Qs1, Qs3, and Qs4 to be turned off, and allows the second switching transistor Qs2 to be turned on. The intermediate voltage Vm has a value between the high voltage Von and the low voltage Voff, and allows the fourth switching transistor Qs4 to be turned on. The sustain voltage Vsus is a substantially lower voltage than the driving voltage Vdd. The sustain voltage Vsus is applied through a sustain voltage line, and the driving voltage Vdd is applied through a driving voltage line.

The data driver 500 is connected to data lines $D_1$-$D_m$ of the display panel 300 and applies the data voltage Vdat that represents an image signal to the data lines $D_1$-$D_m$.

The signal controller 600 controls operations of the scanning driver 400 and the data driver 500.

Each of the driving devices 400, 500, and the controller 600 may be directly mounted on the display panel 300 in at least one IC chip form, may be mounted on a flexible printed circuit film (not shown) to be attached to the display panel 300 in a tape carrier package (TCP) form, or may be mounted on a separate printed circuit board (PCB) (not shown). Alternatively, the driving devices 400, 500, and the controller 600 together with the signal lines $G_{a1}$-$G_{bn}$ and $D_1$-$D_m$ and the transistor Qs1-Qs4 and Qd may be integrated with the display panel 300. Further, the driving devices 400, 500, and the controller 600 may be integrated into a single chip. In this case, at least one of them or at least one circuit element constituting them may be disposed outside of the single chip.

A display operation of the organic light emitting device will now be described in detail with reference to FIGS. 1 to 8.

Figure 3:
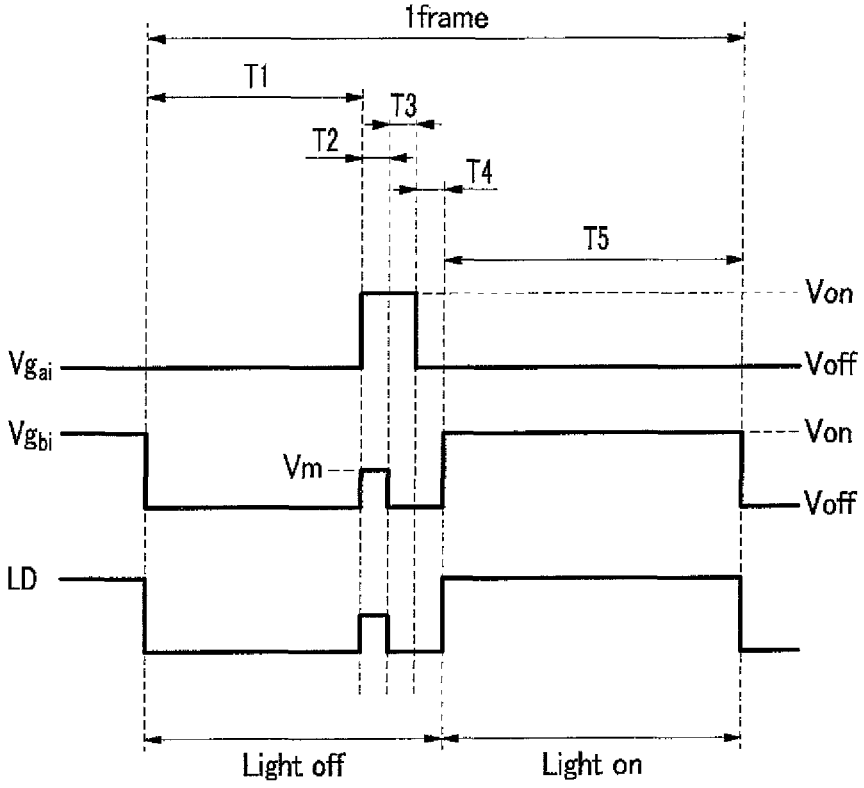
FIG. 3 is a waveform diagram illustrating a driving signal that is applied to pixels of one row in an organic light emitting device according to an exemplary embodiment of the present invention.

FIG. 3 is a waveform diagram illustrating a driving signal that is applied to pixels of one row in an organic light emitting device according to an exemplary embodiment of the present invention, and FIGS. 4 to 7 are equivalent circuit diagrams of one pixel at each of the periods shown in FIG. 3.

The signal controller 600 receives an input image signal Din and an input control signal ICON for controlling the display of the input image signal Din from an external graphics controller (not shown). The input image signal Din contains luminance information of each pixel PX, and luminance corresponds to a predetermined gray value, for example $1024=2^{10}$, $256=2^8$, or $64=2^6$. The input control signal ICON includes, for example, a vertical synchronization signal, a horizontal synchronizing signal, a main clock signal, and a data enable signal.

The signal controller 600 appropriately processes the input image signal Din to correspond to an operating condition of the display panel 300 based on the input image signal Din and the input control signal ICON, and generates a scanning control signal CONT1 and a data control signal CONT2. The signal controller 600 sends the scanning control signal CONT1 to the scanning driver 400, and sends the data control signal CONT2 and an output image signal Dout to the data driver 500.

The scanning control signal CONT1 may include a scanning start signal for instructing the scanning start of the high voltage Von to the scanning signal lines $G_{a1}$-$G_{bn}$ and the compensation signal lines $S_1$-$S_n$, at least one clock signal for controlling an output period of the high voltage Von, and an output enable signal for limiting a time duration of the high voltage Von.

The data control signal CONT2 includes a horizontal synchronization start signal for notifying the transmission start of a digital image signal Dout for pixels PX of one row, and a load signal and a data clock signal for allowing an analog data voltage to be applied to the data lines $D_1$-$D_m$.

The scanning driver 400 sequentially changes a voltage of a scanning signal that is applied to the scanning signal lines $G_{a1}$-$G_{bn}$ to a high voltage Von and again to a low voltage Voff according to the scanning control signal CONT1 from the signal controller 600.

The data driver 500 receives a digital output image signal Dout for pixels PX of each row, converts the output image signal Dout to an analog data voltage Vdat, and then applies the analog data voltage Vdat to the data lines $D_1$-$D_m$, according to the data control signal CONT2 from the signal controller 600. The data driver 500 outputs a data voltage Vdat for pixels PX of one row for one horizontal period 1H, as shown in FIG. 3.

Hereinafter, a specific pixel row, for example an i-th, row will be described.

Referring to FIG. 3, the scanning driver 400 outputs a first scanning signal Vgai that is applied to the first scanning signal line $G_{ai}$ at a low voltage Voff and changes a voltage of a second scanning signal Vgbi that is applied to the second scanning signal line $G_{bi}$ from a high voltage Von to a low voltage Voff, according to the scanning control signal CONT1 from the signal controller 600.

Figure 4:
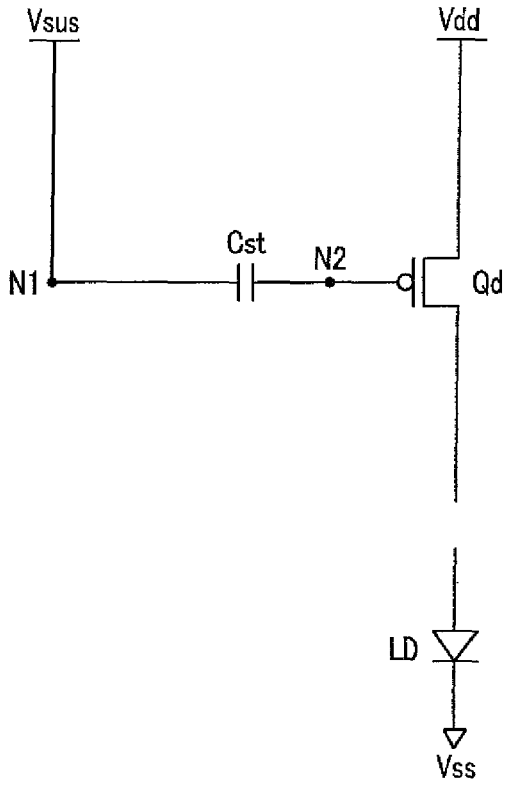
FIGS. 4 to 7 are equivalent circuit diagrams of one pixel at each of the periods shown in FIG. 3.

Accordingly, as shown in FIG. 4, the first, third, and fourth switching transistors Qs1, Qs3, and Qs4, respectively, are turned off, and the second switching transistor Qs2 is turned on. Because the fourth switching transistor Qs4 is turned off, light emission of the organic light emitting element LD stops, and this is referred to as a first period T1, as shown in FIG. 3. At the first period T1, a sustain voltage Vsus is applied to the contact point N1.

Thereafter, the scanning driver 400 changes a voltage of the first scanning signal Vgai that is applied to the first scanning signal line $G_{ai}$ from a low voltage Voff to a high voltage Von and changes the second scanning signal Vgbi that is applied to the second scanning signal line $G_{bi}$ from a low voltage Voff to an intermediate voltage Vm, according to the scanning control signal CONT1 from the signal controller 600.

Figure 5:
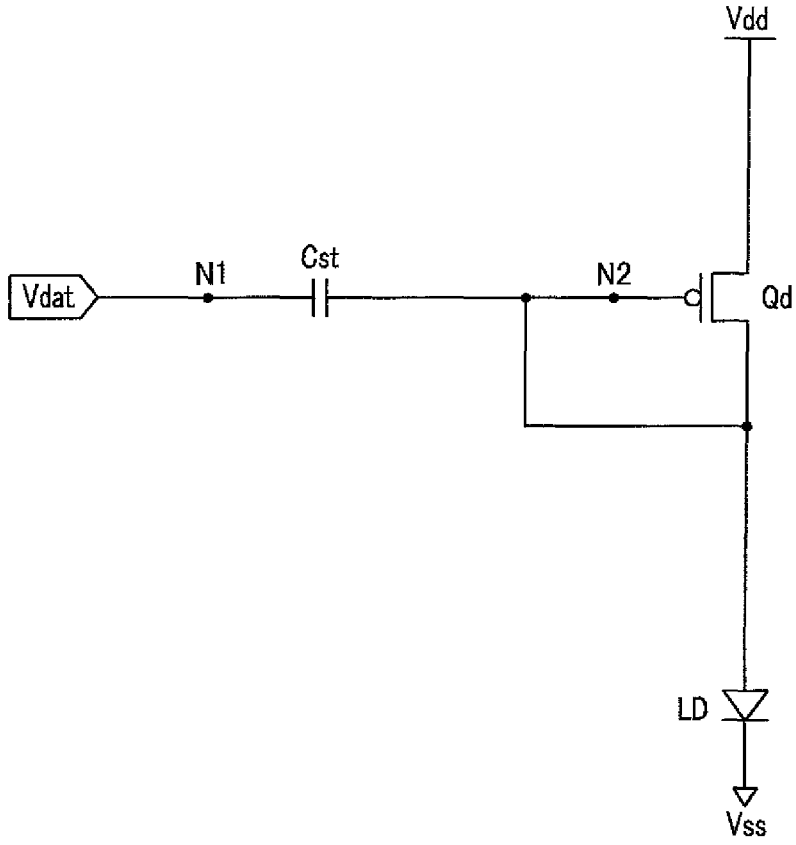

Accordingly, as shown in FIG. 5, the first, third, and fourth switching transistors Qs1, Qs3, and Qs4, respectively, are turned on and the second switching transistor Qs2 is turned off, and this is referred to as a second period T2, as shown in FIG. 3.

At the second period T2, a data voltage Vdat is applied to the contact point N1, and a voltage difference between the two contact points N1 and N2 is stored at the capacitor Cst. The driving transistor Qd is turned on to allow a current to flow, and because the fourth switching transistor Qs4 is turned on, the current flows toward the organic light emitting element LD. Furthermore, because the third switching transistor Qs3 is turned on, charges that are built up at the contact point N2 may be discharged.

In this case, the fourth switching transistor Qs4 is weakly turned on by an intermediate voltage Vm that is lower than the high voltage Von. Accordingly, because resistance is large at a portion corresponding to the fourth switching transistor Qs4, most of a voltage between a driving voltage Vdd and a common voltage Vss is distributed into a portion corresponding to the fourth switching transistor Qs4 and, thus, a voltage between an anode and a cathode of the organic light emitting element LD is relatively lowered. Therefore, because a voltage between both terminals of the organic light emitting element LD is merely a voltage of a level that fills capacitance of the organic light emitting element LD itself, a current hardly flows to the organic light emitting element LD and thus the organic light emitting element LD does not emit light.

Next, the scanning driver 400 outputs a voltage of a scanning signal Vgai that is applied to the first scanning signal line $G_{ai}$ at a high voltage Von and changes a voltage of the second scanning signal Vgbi that is applied to the second scanning signal line $G_{bi}$ from an intermediate voltage Vm to a low voltage Voff, according to the scanning control signal CONT1 from the signal controller 600.

Figure 6:
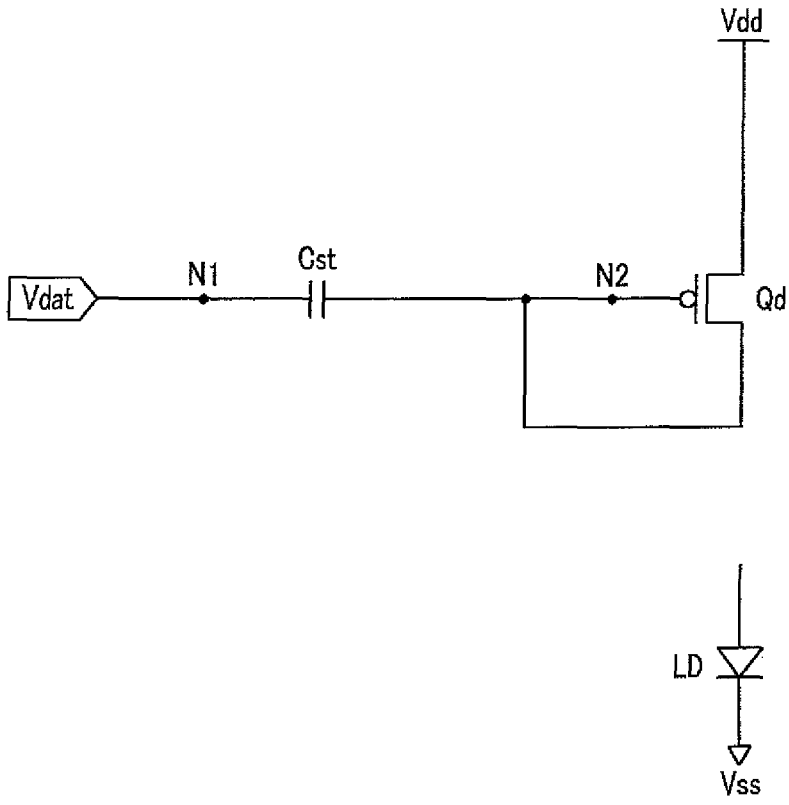

Accordingly, as shown in FIG. 6, the first and third switching transistors Qs1 and Qs3, respectively, sustain a turned on state, the second switching transistor Qs2 sustains a turned off state, and the fourth switching transistor Qs4 is turned off. This is referred to as a third period T3, as shown in FIG. 3.

Because the driving transistor Qd sustains a turn-on state at the third period T3, charges that have been charged at the capacitor Cst are discharged through the driving transistor Qd. This discharge stops after a voltage difference between the control terminal and the input terminal of the driving transistor Qd becomes a threshold voltage Vth of the driving transistor Qd.

Accordingly, a voltage $V_{N2}$ of the contact point N2 approaches a voltage value given by Equation 1.

$$V_{N2}=Vdd+Vth \quad \text{(Equation 1)}$$

In this case, because a voltage $V_{N1}$ of the contact point N1 sustains a data voltage Vdat, a voltage that is stored at the capacitor Cst is represented by Equation 2.

$$V_{N1}-V_{N2}=Vdat-(Vdd+Vth) \quad \text{(Equation 2)}$$

Thereafter, the scanning driver 400 changes a voltage of the first scanning signal Vgai that is applied to the first scanning signal line $G_{ai}$ from a high voltage Von to a low voltage Voff and sustains a voltage of the second scanning signal Vgbi that is applied to the second scanning signal line $G_{bi}$ at a low voltage Voff, according to the scanning control signal CONT1 from the signal controller 600.

Accordingly, as shown in FIG. 4, the first and third switching transistors Qs1 and Qs3 are turned off, the second switching transistor Qs2 is turned on, and the fourth switching transistor Qs4 sustains a turned off state. This is referred to as a fourth period T4, as shown in FIG. 3.

At the fourth period T4, because a voltage that is stored at the capacitor Cst is sustained, the driving transistor Qd is turned on and allows a current to flow, but because the fourth switching transistor Qs4 is turned off, and the organic light emitting element LD does not emit light.

Thereafter, the scanning driver 400 sustains a voltage of the first scanning signal Vgai that is applied to the first scanning signal line $G_{ai}$ at a low voltage Voff and changes a voltage of the second scanning signal Vgbi that is applied to the second scanning signal line $G_{bi}$ from a low voltage Voff to a high voltage Von, according to the scanning control signal CONT1 from the signal controller 600.

Figure 7:
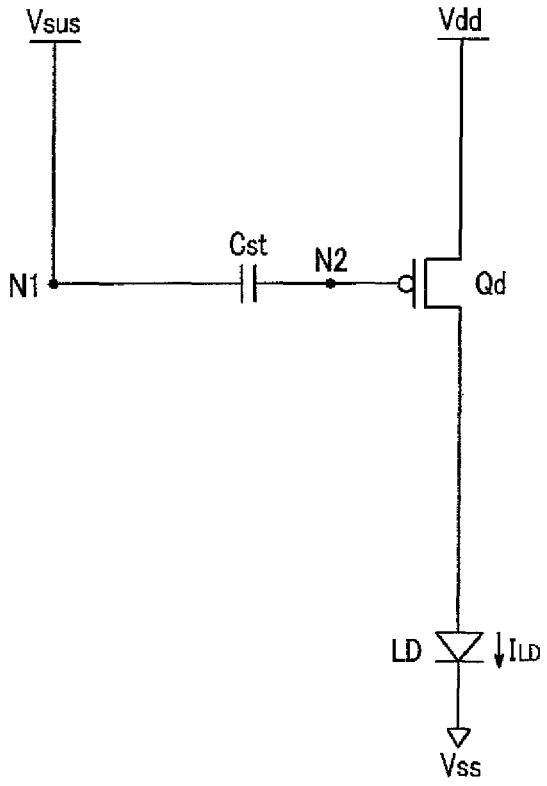

Accordingly, as shown in FIG. 7, the first and third switching transistors Qs1 and Qs3, respectively, sustain a turned off state, the second switching transistor Qs2 sustains a turned on state, and the fourth switching transistor Qs4 is turned on. This is referred to as a fifth period T5, as shown in FIG. 3.

At the fifth period T5, the contact point N1 is separated from the data voltage Vdat and connected to a sustain voltage Vsus, and the control terminal of the driving transistor Qd is floated.

Therefore, a voltage $V_{N2}$ of the contact point N2 is represented by Equation 3.

$$V_{N2}=Vdd+Vth-Vdat+Vsus \quad \text{(Equation 3)}$$

By turning on the fourth switching transistor Qs4, the output terminal of the driving transistor Qd is connected to the organic light emitting element LD, and the driving transistor Qd allows an output current $I_{LD}$, which is controlled by a voltage difference Vgs between the control terminal and the input terminal of the driving transistor Qd, to flow.

$$\begin{aligned} I_{LD} &= 1/2\times K\times(Vgs-Vth)^2 \quad \text{(Equation 4)} \\ &= 1/2\times K\times(V_{N2}-Vdd-Vth)^2 \\ &= 1/2\times K\times(Vdd+Vth-Vdat+Vsus-Vdd-Vth)^2 \\ &= 1/2\times K\times(Vsus-Vdat)^2 \end{aligned}$$

Herein, K is a constant according to characteristics of the driving transistor Qd, K=μCiW/L, μ is electric field effect mobility, Ci is capacity of a gate insulating layer, W is a channel width of the driving transistor Qd, and L is a channel length of the driving transistor Qd.

According to Equation 4, the output current $I_{LD}$ at the light emitting period T5 is determined only by the data voltage Vdat and the fixed sustain voltage Vsus. Therefore, the output current Ito is not influenced by a threshold voltage Vth of the driving transistor Qd.

The output current $I_{LD}$ is supplied to the organic light emitting element LD, and the organic light emitting element LD emits light with different intensities according to a magnitude of the output current $I_{LD}$, thereby displaying an image.

Therefore, even if there is a deviation in a threshold voltage Vth between the driving transistors Qd, or even if a magnitude of a threshold voltage Vth of each driving transistor Qd sequentially changes, a uniform image can be displayed.

The fifth period T5 is continued until a first period T1 for a pixel PX of an i-th row restarts at a next frame, and at the pixel PX of a next row, the operation at each of the periods T1-T5 is repeated. For example, a first period T1 of an (i+1)th row starts after a fifth period T5 of the i-th row is terminated. In this way, by sequentially performing the control of the periods T1-T5 at all scanning signal lines $G_{a1}$-$G_{bn}$, corresponding images are displayed at all pixels PXs.

As described above, at the first, third, and fourth periods T1, T3, and T4, respectively because the fourth switching transistor Qs4 is turned off, the organic light emitting element LD does not emit light. At the second period T2, because the fourth switching transistor Qs4 is weakly turned on, the organic light emitting element LD also does not emit light. At the fifth period T5, because the fourth switching transistor Qs4 is turned on, the organic light emitting element LD emits light. In this exemplary embodiment, the first period T1 secures a time period of a period in which the organic light emitting element LD does not emit light, and the fourth period T4 functions as a shock-absorbing time period before a time point in which the organic light emitting element LD starts light emission. In this way, if one frame is divided into periods T1-T4 in which the organic light emitting element LD does not emit light and a period T5 in which the organic light emitting element LD does emit light, a screen is displayed with black for the periods T1-T4 in which the organic light emitting element LD does not emit light and thus an impulse driving effect can be obtained. Therefore, an image can be prevented from blurring.

If the organic light emitting element LD unintentionally emits light for the first to fourth periods T1-T4, which are periods in which the organic light emitting element LD should not emit light, the contrast ratio of the organic light emitting device may be deteriorated. According to an exemplary embodiment of the present invention, however, because the second scanning signal Vgbi is applied at an intermediate voltage Vm, not a high voltage Von at the second period T2, the organic light emitting element LD may hardly emit light even while discharging charges that are stacked at the control terminal and the output terminal of the driving transistor Qd. Therefore, a favorable contrast ratio of the organic light emitting device can be sustained.

The sum of the first to fourth periods T1-T4 may be equal to a length of the fifth period T5. Therefore, the sum of the first to fourth periods T1-T4 and the fifth period T5 may be about a half frame. Lengths of each of the periods T1-T5, however, may be adjusted as needed.

A scanning driver for generating a scanning signal of an organic light emitting device according to an exemplary embodiment of the present invention will now be described in detail with reference to FIGS. 8 and 9.

Figure 8:
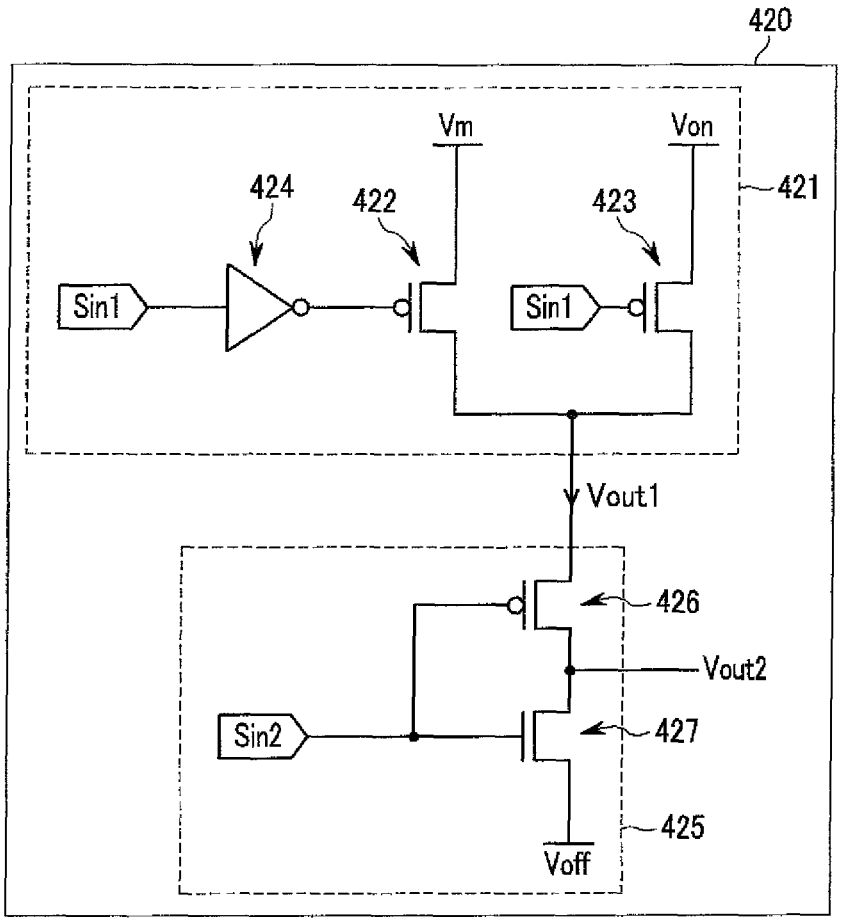
FIG. 8 is a circuit diagram illustrating a second scanning driver of an organic light emitting device according to an exemplary embodiment of the present invention.
Figure 9:
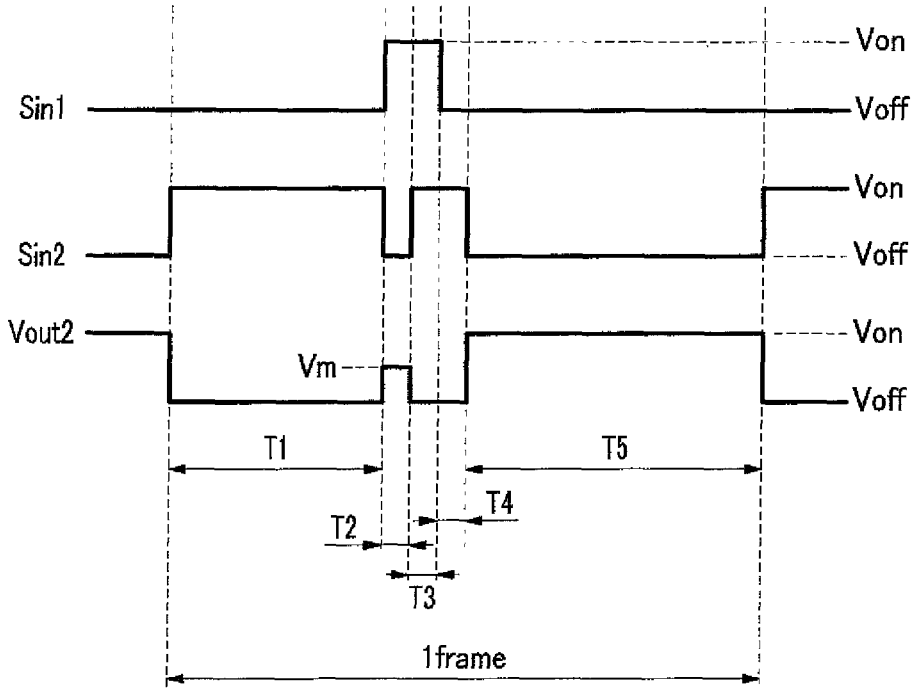
FIG. 9 is a waveform diagram illustrating an input signal and an output signal of the second scanning driver of FIG. 8.

FIG. 8 is a circuit diagram illustrating a second scanning driver 420 shown in FIG. 2 of an organic light emitting device according to an exemplary embodiment of the present invention, and FIG. 9 is a waveform diagram of an input signal that is input to the second scanning driver 420 of an organic light emitting device according to an exemplary embodiment of the present invention.

Referring to FIG. 8, the second scanning driver 420 of the organic light emitting device according to an exemplary embodiment of the present invention includes a multiplexer 421 and a first inverter 425 that are connected to each other.

The multiplexer 421 selects one of an intermediate voltage Vm or a high voltage Von according to the first input signal Sin1, and sends the selected voltage as a first output signal Vout1 to the first inverter 425.

The multiplexer 421 includes first and second transistors 422 and 423 that are generally coupled in parallel, and the first and second transistors 427 and 423 are each a p-channel electric field effect transistor. A second inverter 424 is connected to the control terminal of the first transistor 422, and the first input signal Sin1 is applied to an input terminal of the second inverter 424. The intermediate voltage Vm is connected to an input terminal of the first transistor 422. The first input signal Sin1 is connected to the control terminal of the second transistor 423, and the high voltage Von is connected to an input terminal thereof.

The first inverter 475 outputs either the first output signal Vout1 or a low voltage Voff as a second output signal Vout2 according to a second input signal Sin2. As a second scanning signal Vgbi, the second output signal Vout2 is applied to second scanning signal lines $G_{b1-n}$.

The first inverter 425 includes third and fourth transistors 426 and 427, respectively, that are coupled in series to each other, channel types of the third and fourth transistors 426 and 427 are opposite to each other, the third transistor 426 is a p-channel electric field effect transistor, and the fourth transistor 427 is an n-channel electric field effect transistor. Control terminals of the third and fourth transistors 426 and 427, respectively, are commonly connected to the second input signal Sin2, an input terminal of the third transistor 426 is connected to the first output signal Vout1, and an input terminal of the fourth transistor 427 is connected to a low voltage Voff.

Channel types of each of the transistors 422, 423, 426, and 427 may be reversed. In this case, waveforms of signals for driving them would be also inverted.

The first and second input signals Sin1 and Sin2, respectively, are shown in a waveform diagram of FIG. 9. The first and second input signals Sin1 and Sin2 consist of a high voltage Von and a low voltage Voff, respectively. The first and second input signals Sin1 and Sin2 may be formed by logically combining several clock signals, and the first and second input signals Sin1 and Sin2 may be formed by a logic circuit outside or inside the scanning driver 400.

A process of generating the second scanning signal Vgbi will now be described in detail with reference to FIGS. 8 and 9.

Initially, at a first period T1, because the first input signal Sin1 is a low voltage Voff, a high voltage Von is applied to the control terminal of the first transistor 422 and a low voltage Voff is applied to the control terminal of the second transistor 423. Therefore, the first transistor 422 is turned off and the second transistor 423 is turned on. Accordingly, a high voltage Von is output as the first output signal Vout1. At the first period T1, because the second input signal Sin2 is a high voltage Von, the third transistor 426 is turned off and the fourth transistor 427 is turned on. Accordingly, a low voltage Voff is output as the second output signal Vout2.

At the second period T2, because the first input signal Sin1 is a high voltage Von, a low voltage Voff is applied to a control terminal of the first transistor 422 and a high voltage Von is applied to a control terminal of the second transistor 423. Therefore, the first transistor 422 is turned on and the second transistor 423 is turned off. Accordingly, an intermediate voltage Vm is output as the first output signal Vout1. At the second period T2, because the second input signal Sin2 is a low voltage Voff, the third transistor 426 is turned on and the fourth transistor 427 is turned off. Accordingly, the intermediate voltage Vm, which is the first output signal Vout1, is output as the second output signal Vout2.

At a third period T3, because the first input signal Sin1 is a high voltage Von, a low voltage Voff is applied to the control terminal of the first transistor 422 and a high voltage Von is applied to the control terminal of the second transistor 423. Therefore, the first transistor 422 is turned on and the second transistor 423 is turned off. Accordingly, the intermediate voltage Vm is output as the first output signal Vout1. At the third period T3, because the second input signal Sin2 is a high voltage Von, the third transistor 426 is turned off and the fourth transistor 427 is turned on. Accordingly, a low voltage Voff is output as the second output signal Vout2.

At a fourth period T4, because the first input signal Sin1 is a low voltage Voff, a high voltage Von is applied to the control terminal of the first transistor 422 and a low voltage Voff is applied to the control terminal of the second transistor 423. Therefore, the first transistor 422 is turned off and the second transistor 423 is turned on. Accordingly, the high voltage Von is output as the first output signal Vout1. At the fourth period T4, because the second input signal Sin2 is a high voltage Von, the third transistor 426 is turned off and the fourth transistor 427 is turned on. Accordingly, the low voltage Voff is output as the second output signal Vout2.

At a fifth period T5, because the first input signal Sin1 is a low voltage Voff, a high voltage Von is applied to the control terminal of the first transistor 422 and a low voltage Voff is applied to the control terminal of the second transistor 423. Therefore, the first transistor 477, is turned off and the second transistor 423 is turned on. Accordingly, the high voltage Von is output as the first output signal Vout1. At the fifth period T5, because the second input signal Sin2 is a low voltage Voff the third transistor 426 is turned on and the fourth transistor 427 is turned off. Accordingly, the high voltage Von, which is the first output signal Vout1, is output as the second output signal Vout2.

The second output signal Vout2 is applied to each of the second scanning signal lines $G_{b1-n}$ as the second scanning signal Vgbi.

The first input signal Sin1 is the same as the first scanning signal Vgai. The first scanning driver 410 shown in FIG. 1 may include a plurality of shift registers (not shown), and the first input signals Sin1 are input to the first scanning driver 410 and are sequentially delayed and thus are applied to each of first scanning signal lines $G_{a1-n}$.

An organic light emitting device according to an exemplary embodiment of the present invention will now be described in detail with reference to FIGS. 10 to 14.

Figure 10:
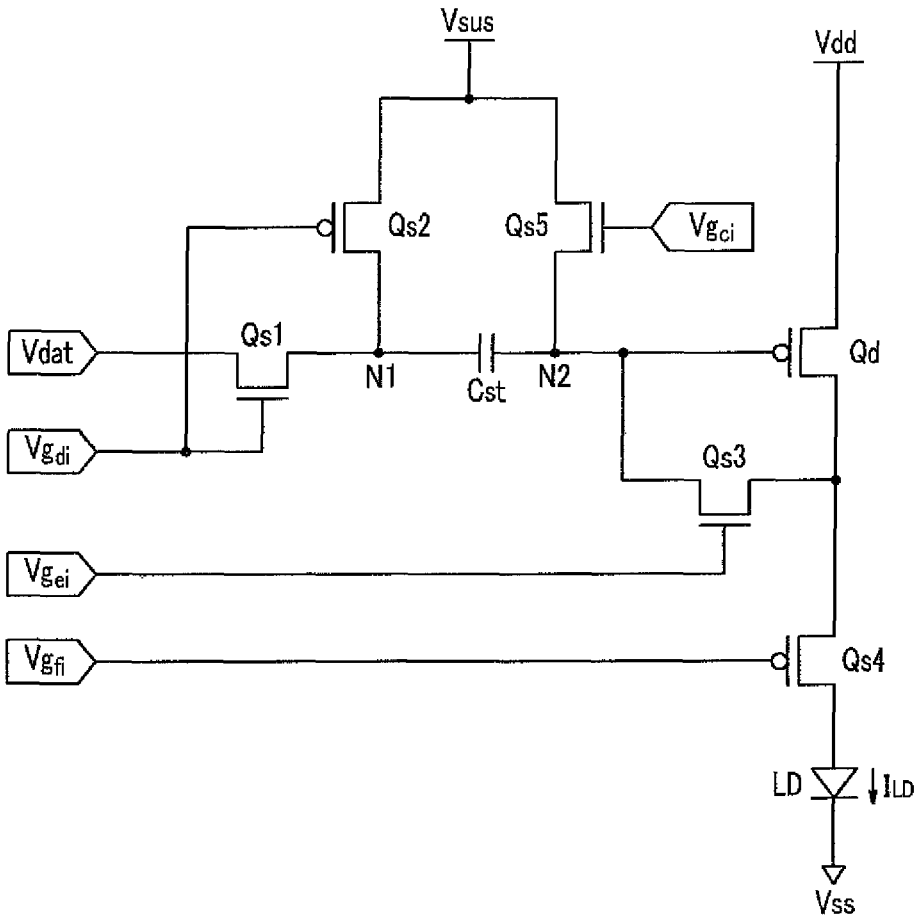
FIG. 10 is an equivalent circuit diagram of one pixel of an organic light emitting device according to an exemplary embodiment of the present invention.
Figure 11:
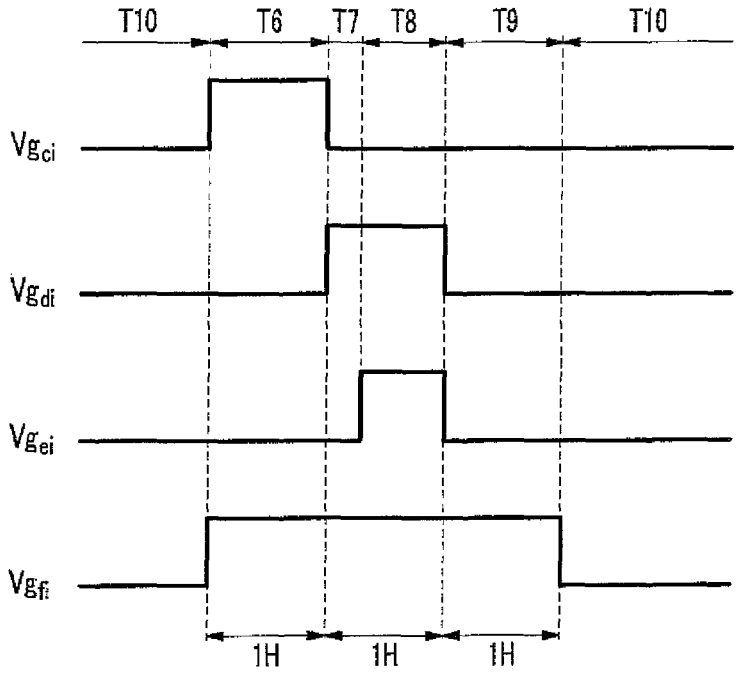
FIG. 11 is a waveform diagram illustrating a driving signal that is applied to pixels of one row in an organic light emitting device according to an exemplary embodiment of the present invention.

FIG. 10 is an equivalent circuit diagram of one pixel of an organic light emitting device according to an exemplary embodiment of the present invention, FIG. 11 is a waveform diagram illustrating a driving signal that is applied to pixels of one row in an organic light emitting device according to the exemplary embodiment of the present invention, shown in FIG. 10, and FIGS. 12 to 14 are equivalent circuit diagrams of one pixel at each period shown in FIG. 11.

Like the organic light emitting device that is shown in FIG. 1, the organic light emitting device according to an exemplary embodiment of the present invention includes a display panel 300, a scanning driver 400, a data driver 500, and a signal controller 600. Unlike the organic light emitting device of FIG. 1, however, in the organic light emitting device according to the current exemplary embodiment of the present invention, four scanning signal lines for transferring each of a third scanning signal Vgci, a fourth scanning signal Vgdi, a fifth scanning signal Vgei, and a sixth scanning signal Vgfi are connected to one pixel PX. Accordingly, the scanning driver 400 includes four sub-scanning drivers (not shown) that generate each of the third to sixth scanning signals Vgci, Vgdi, Vgei, and Vgfi.

Referring to FIG. 10, like the organic light emitting device that is shown in FIG. 2, a pixel of the organic light emitting device according to the current exemplary embodiment of the present invention includes an organic light emitting element LD, a driving transistor Qd, a capacitor Cst, and first, second, third, and fourth switching transistors Qs1, Qs2, Qs3, and Qs4 respectively.

Unlike the organic light emitting device of FIG. 2, however, the organic light emitting device of FIG. 10 further includes a fifth switching transistor Qs5. The fifth switching transistor Qs5 operates in response to the third scanning signal Vgci, and is an n-channel electric field effect transistor that is connected between a contact point N2 and a sustain voltage Vsus.

Furthermore, in the organic light emitting device of FIG. 10, the first and second switching transistors Qs1 and Qs2 operate in response to the fourth scanning signal Vgdi, the third switching transistor Qs3 operates in response to the fifth scanning signal Vgei, and the fourth switching transistor Qs4 operates in response to the sixth scanning signal Vgfi.

Alternatively, the fifth switching transistor Qs5 may be controlled using a fourth scanning signal Vgd (i−1) of an (i−1) th row instead of the third scanning signal Vgci.

Hereinafter, a specific pixel row, for example an i-th row, will be described.

Referring to FIG. 11, the scanning driver 400 shown in FIG. 1 changes a voltage of the third and sixth scanning signals Vgci and Vgfi from a low voltage Voff to a high voltage Von and sustains a voltage of the fourth and fifth scanning signals Vgdi and Vgei at a low voltage Voff, according to a scanning control signal CONT1 from the signal controller 600 shown in FIG. 1.

Figure 12:
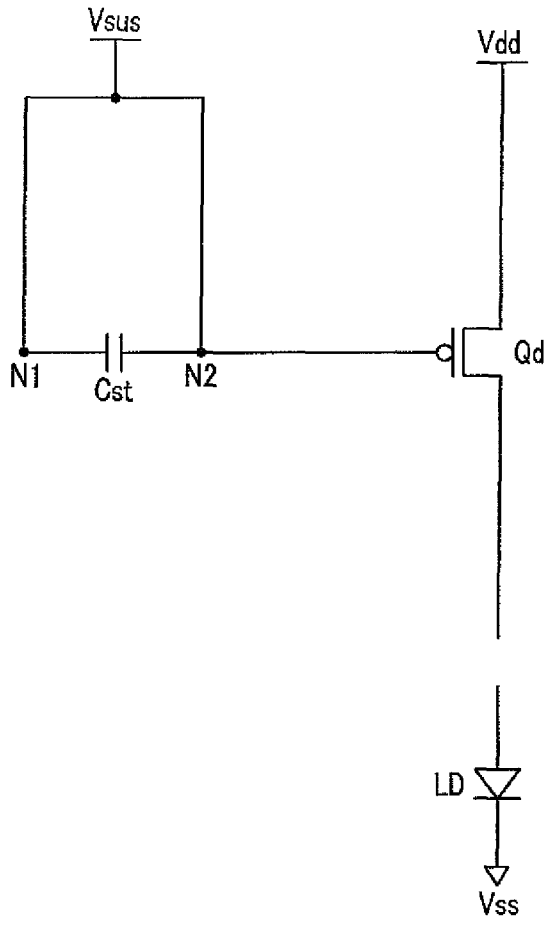
FIGS. 12 to 14 are equivalent circuit diagrams of one pixel at each of the periods shown in FIG. 11.

Accordingly, as shown in FIG. 12, the first, third, and fourth switching transistors Qs1, Qs3, and Qs4, respectively, are turned off, and the second and fifth switching transistors Qs2 and Qs5, respectively, are turned on Because the fourth switching transistor Qs4 is turned off, light emission of the organic light emitting element LD stops, and this is referred to as a sixth period T6 shown in FIG. 11. At the sixth period T6, because a sustain voltage Vsus is applied to two contact points N1 and N2, a voltage that is charged at the capacitor Cst is 0 and the control terminal of the driving transistor Qd is reset to a sustain voltage Vsus. The sixth period T6 is continued for a time period of more than ½H, and preferably for a time period of 1H.

Thereafter, the scanning driver 400 changes a voltage of the third scanning signal Vgci from a high voltage Von to a low voltage Voff, changes a voltage of the fourth scanning signal Vgdi from a low voltage Voff to a high voltage Von, sustains a voltage of the fifth scanning signal Vgei at a low voltage Voff, and sustains a voltage of the sixth scanning signal Vgfi at a high voltage Von, according to a scanning control signal CONT1 from the signal controller 600 shown in FIG. 1.

Figure 13:
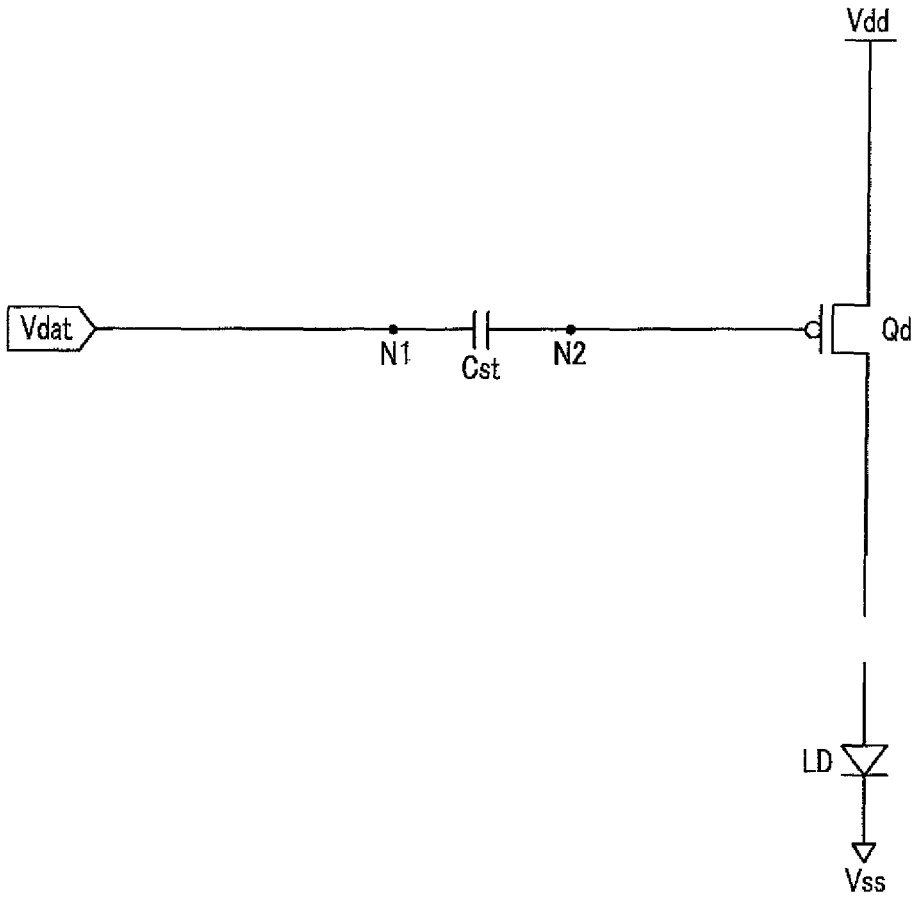

Accordingly, as shown in FIG. 13, the first switching transistor Qs1 is turned on and the second to fifth switching transistors Qs2-5 are turned off, and this is referred to as a seventh period T7 shown in FIG. 11.

At the seventh period T7, a data voltage Vdat is applied to the contact point N1. Because a voltage that is charged at the capacitor Cst is sustained at 0, a voltage of the contact point N2 is also changed to a data voltage Vdat, and a voltage of the control terminal of the driving transistor Qd increases by a voltage Vdat-Vsus. Therefore, the driving transistor Qd is turned on to allow an output current $I_{LD}$ to flow.

Next, as shown in FIG. 11, the scanning driver 400 shown in FIG. 1 sustains a voltage of the third scanning signal Vgci at a low voltage Voff, sustains a voltage of the fourth and sixth scanning signals Vgdi and Vgfi at a high voltage Von, and changes a voltage of the fifth scanning signal Vgei from a low voltage Voff to a high voltage Von, according to the scanning control signal CONT1 from the signal controller 600 shown in FIG. 1.

Accordingly, as shown in FIG. 13, the first switching transistor Qs1 sustains a turned on state, the third switching transistor Qs3 is turned on, and the second, fourth, and fifth switching transistors Qs2, Qs4, and Qs5, respectively, sustain a turned off state, and this is referred to as an eighth period T8 shown in FIG. 11.

At the eighth period T8, the driving transistor Qd sustains a turn-on state, a current flows from a driving voltage Vdd to the output terminal of the driving transistor Qd, and thus a voltage of the control terminal of the driving transistor Qd rises. This discharge continues until a voltage difference between the control terminal and the input terminal of the driving transistor Qd reaches a threshold voltage Vth of the driving transistor Qd.

Therefore, a voltage $V_{N2}$ of the contact point N2 approaches a voltage value of Equation 1. That is, at the eighth period T8, a threshold voltage Vth is written to the control terminal of the driving transistor Qd, and the eighth period T8 is continued for a time period of more than ½H, and preferably for a time period of 1H.

In this case, because a voltage $V_{N1}$ of the contact point N1 sustains a data voltage Vdat, a voltage that is stored at the capacitor Cst is represented by Equation 2.

According to the present exemplary embodiment, at the seventh period T7, after the first switching transistor Qs1 is turned on and a data voltage Vdat is applied to the contact point N1, the eighth period T8 is entered. At the seventh period T7, however, as a voltage of the fifth scanning signal Vgei is changed from a low voltage to a high voltage, the fourth scanning signal Vgdi and the fifth scanning signal Vgei become equal for the seventh period T7 and the eighth period T8 and, thus, while a data voltage is applied to the contact point N1, the control terminal and the output terminal of the driving transistor Qd are connected.

Thereafter, as shown in FIG. 11, the scanning driver 400 shown in FIG. 1 sustains a voltage of the third scanning signal Vgci at a low voltage Voff, changes a voltage of the fourth and fifth scanning signals Vgdi and Vgei from a high voltage Von to the low voltage Voff, and sustains a voltage of the sixth scanning signal Vgfi at the high voltage Von, according to the scanning control signal CONT1 from the signal controller 600 shown in FIG. 1.

The first and third switching transistors Qs1 and Qs3, respectively, are turned off and the second switching transistor Qs2 is turned on, and the fourth and fifth switching transistors Qs4 and Qs5, respectively, sustain a turned off state. The state of the pixel is the same as shown in FIG. 4. This is referred to as a ninth period T9 shown in FIG. 11.

At the ninth period T9, because the contact point N1 is connected to the sustain voltage Vsus, a voltage $V_{N1}$ of the contact point N1 changes by a voltage Vdat−Vsus. Accordingly, because the contact point N2 is connected to the contact point N1 through the capacitor Cst, a voltage $V_{N2}$ of the contact point N2 is represented by Equation 3.

At the ninth period T9, because a voltage that is stored at the capacitor Cst is sustained, the driving transistor Qd is turned on to allow a current to flow, but because the fourth switching transistor Qs4 is turned off, the organic light emitting element LD does not emit light.

Thereafter, the scanning driver 400 shown in FIG. 1 sustains a voltage of the third to fifth scanning signals Vgci, Vgdi, and Vgei at a low voltage Voff and changes a voltage of the sixth scanning signal Vgfi from a high voltage Von to a low voltage Voff, according to the scanning control signal CONT1 from the signal controller 600 shown in FIG. 1.

Figure 14:
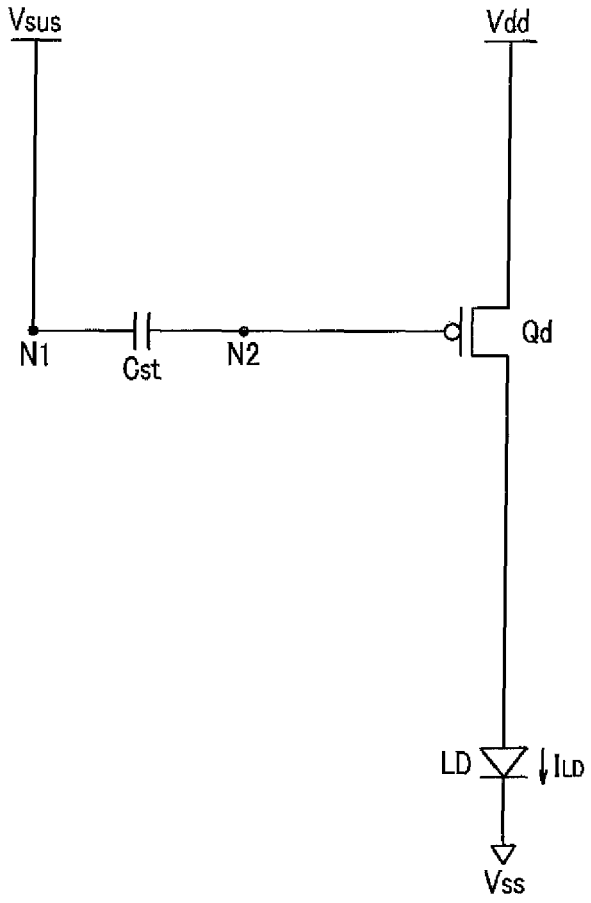

Accordingly, as shown in FIG. 14, the first, third, and fifth switching transistors Qs1, Qs3, and Qs5, respectively, sustain a turned off state, the second switching transistor Qs2 sustains a turned on state, and the fourth switching transistor Qs4 is turned on. This is referred to as a tenth period T10 shown in FIG. 11.

At the tenth period T10, by turning on the fourth switching element Qs4, the output terminal of the driving transistor Qd is connected to the organic light emitting element LD and the driving transistor Qd allows to flow an output current $I_{LD}$ that is controlled by a voltage difference Vgs between the control terminal and the input terminal of the driving transistor Qd.

The output current $I_{LD}$ is represented by Equation 4.

According to Equation 4, the output current $I_{LD}$ at the light emitting period T3 is determined only by a data voltage Vdat and a fixed sustain voltage Vsus. Therefore, the output current $I_{LD}$ is not influenced by a threshold voltage Vth of the driving transistor Qd. The output current $I_{LD}$ is supplied to the organic light emitting element LD, and the organic light emitting element LD emits light with different intensities according to a magnitude of the output current $I_{LD}$, thereby displaying an image.

The tenth period T10 is continued until a sixth period T6 for a pixel PX of an i-th row restarts at a next frame, and at the pixel PX of a next row, operations at each of the periods T6-T10 are repeated.

At the sixth to ninth periods T6, T7, T8, and U9, respectively, because the fourth switching transistor Qs4 is turned off, the organic light emitting element LD does not emit light, and at the tenth period T10, because the fourth switching transistor Qs4 is turned on, the organic light emitting element LD does emit light. The ninth period T9 secures a time period in which the organic light emitting element LD does not emit light. Furthermore, at any time point of the previous tenth period T10 before the start of the sixth period T6, as a voltage of a sixth scanning signal Vgfi is previously changed from a low voltage to a high voltage, the fourth switching transistor Qs4 is turned on and thus a period in which the organic light emitting element LD does not emit light can be increased. A period in which the organic light emitting element LD does emit light and a period in which the organic light emitting element LD does not emit light can be equally divided within one frame. A length of each of the periods T6-T10 can be adjusted, however, as needed. In this way, if one frame is divided into periods T6-T9 in which the organic light emitting element LD does not emit light and a period T10 in which the organic light emitting element LD does emit light, for the periods T6-T9 in which the organic light emitting element LD does not emit light, because a screen is displayed with black, an impulse driving effect can be obtained. Therefore, an image can be prevented from blurring.

In an organic light emitting device according to the present exemplary embodiment, the sixth period T6 that resets the control terminal of the driving transistor Qd to a sustain voltage Vsus and the eighth period T8 that writes a threshold voltage Vth to the control terminal of the driving transistor Qd are independently performed.

The sixth period T6 and the eighth period T8 may be simultaneously performed, however, and this will be described in detail with reference to FIG. 15.

Figure 15:
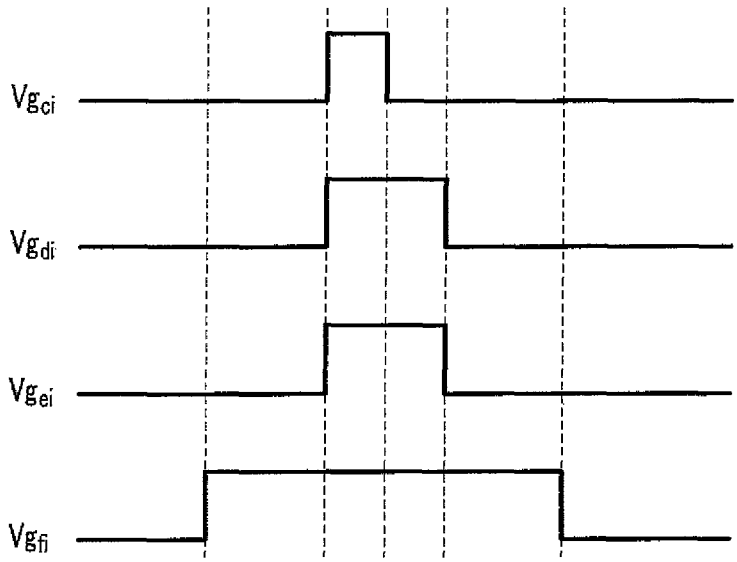
FIG. 15 is a waveform diagram illustrating another driving signal that is applied to pixels of one row in the organic light emitting device of FIG. 10.

FIG. 15 is a waveform diagram illustrating a driving signal that is applied to pixels of one row in the organic light emitting device shown in FIG. 10.

Referring to FIG. 15, at a period in which the third scanning signal Vgci is a high voltage Von, the fourth and fifth scanning signals Vgdi and Vgei are also a high voltage. Therefore, when the fifth switching transistor Qs5 is turned on, the first and third switching transistors Qs1 and Qs3, respectively, are electrically connected. Thereafter, for a predetermined time period after a voltage of the third scanning signal Vgci is changed to a low voltage Voff, voltages of the fourth and fifth scanning signals Vgdi and Vgei sustain a high voltage Von. Accordingly, while the driving transistor Qd is reset to a sustain voltage Vsus, a data voltage Vdat is applied to the first contact point N1, and the output terminal of the driving transistor Qd is connected to the second contact point N2.

Furthermore, according to an exemplary embodiment of the present invention, each of the sixth period T6 and the eighth period T8 is performed for a time period of ½H, and preferably for a time period of 1H. Accordingly, even if a general delay occurs in a scanning signal, the control terminal of the driving transistor Qd can be fully reset to the sustain voltage Vsus and a threshold voltage Vth can be fully written to the control terminal of the driving transistor Qd. Therefore, high resolution driving of the organic light emitting device can be performed.

An organic light emitting device according to an exemplary embodiment of the present invention will now be described in detail with reference to FIG. 16.

Figure 16:
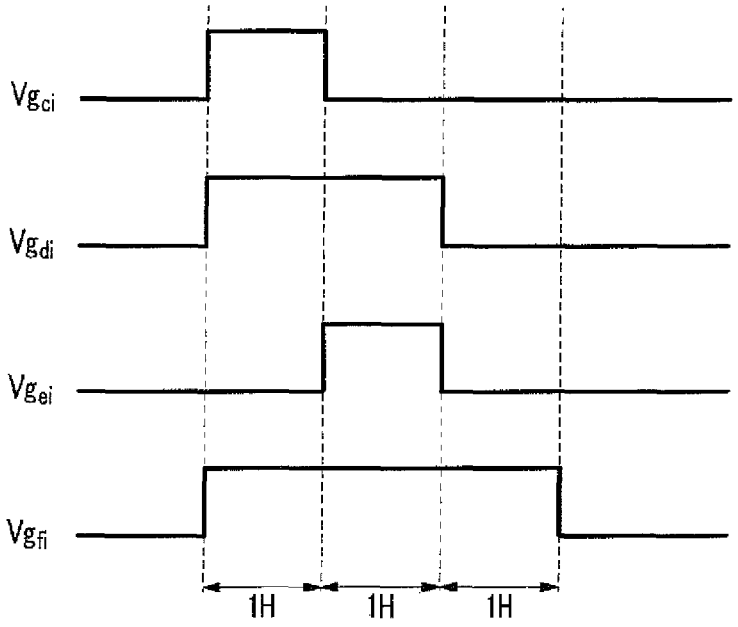
FIG. 16 is a waveform diagram illustrating another driving signal that is applied to pixels of one row in the organic light emitting device of FIG. 10.

FIG. 16 is a waveform diagram illustrating a driving signal that is applied to pixels of one row in the organic light emitting device shown in FIG. 10.

Referring to FIG. 16, unlike what is shown in FIG. 11, a period in which the fourth scanning signal Vgdi sustains a high voltage Von is 2H, and the front 1H of the 2H overlaps with a sustain period of a high voltage Von of the third scanning signal Vgci. Unlike what is shown in FIG. 11, in FIG. 16, in order to write a threshold voltage after a data voltage Vdat is applied to a contact point N1, it is unnecessary to slow down a change time point of a high voltage Von of the fifth scanning signal Vgei. Therefore, because a sustain period of a high voltage Von of the fifth scanning signal Vgei can be sustained for a relatively long time, a threshold voltage Vth can be more smoothly written, and a large area can be thus easily driven.

Alternatively, the fifth switching transistor Qs5 may be controlled using a fifth scanning signal Vge (i−1) of an (i−1)th row instead of the third scanning signal Vgci.

An organic light emitting device according to an exemplary embodiment of the present invention will now be described in detail with reference to FIG. 17.

Figure 17:
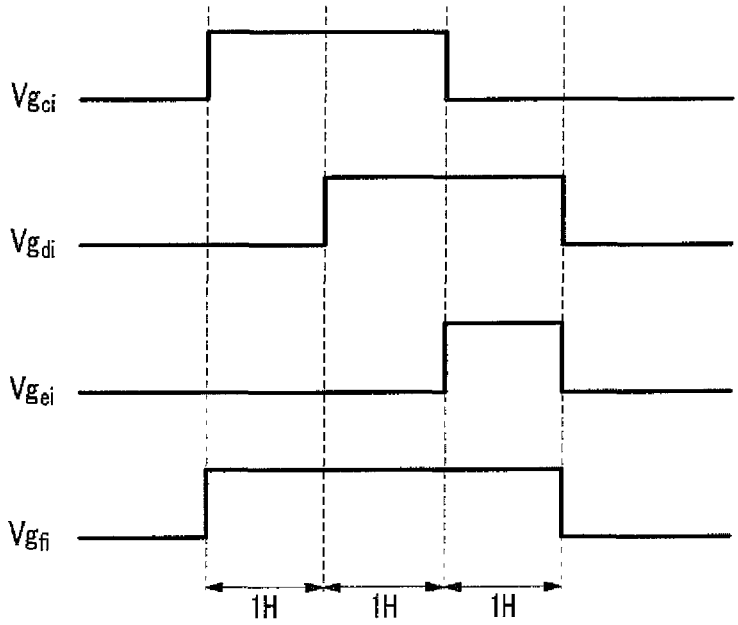
FIG. 17 is a waveform diagram illustrating another driving signal that is applied to pixels of one row in the organic light emitting device of FIG. 10.

FIG. 17 is a waveform diagram illustrating a driving signal that is applied to pixels of one row in the organic light emitting device shown in FIG. 10.

Referring to FIG. 17, unlike what is shown in FIGS. 11 and 16, in both of the third and fourth scanning signals Vgci and Vgdi, a period that sustains a high voltage Von is 2H. Therefore, because a reset period of the driving transistor Qd can be sustained for a longer time, the fifth switching transistor Qs5 that is related to the reset operation can be designed to be small and thus a large display area can be easily driven.

Alternatively, the fifth switching transistor Qs5 may be controlled using a fourth scanning signal Vgd (i−1) of an (i−1)th row instead of the third scanning signal Vgci.

An organic light emitting device according to an exemplary embodiment of the present invention will now be described in detail with reference to FIG. 18.

Figure 18:
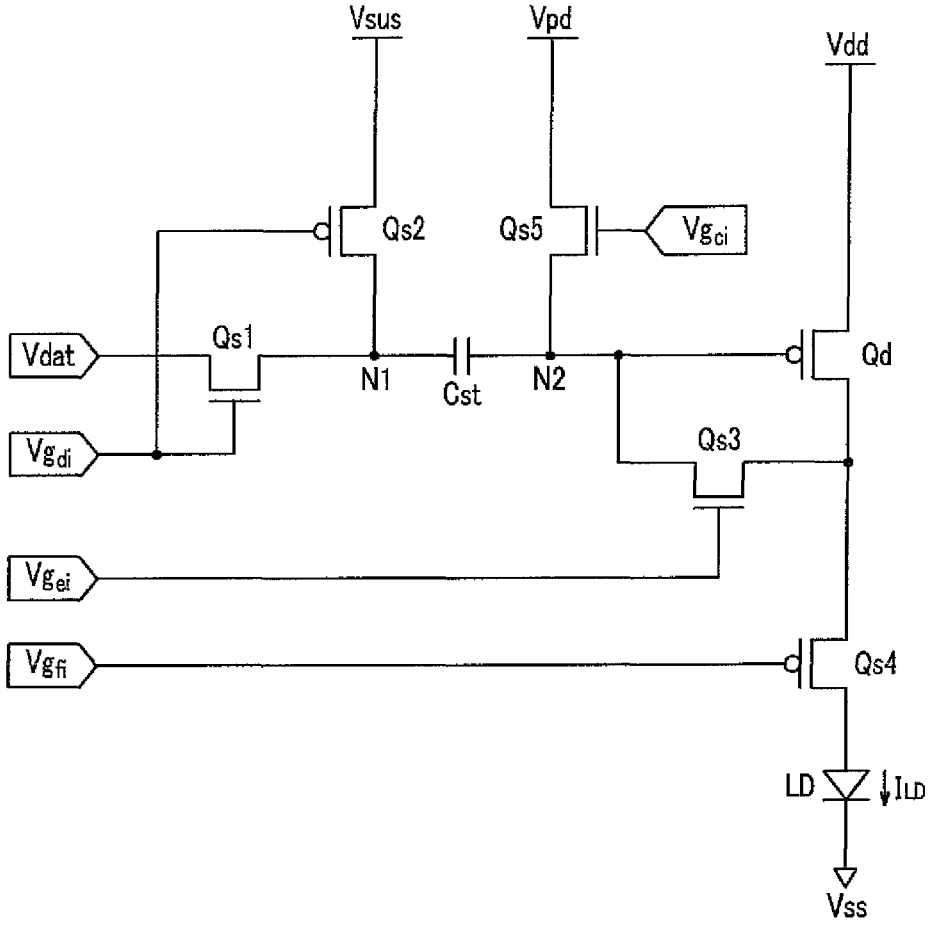
FIG. 18 is an equivalent circuit diagram of one pixel of an organic light emitting device according to an exemplary embodiment of the present invention.

FIG. 18 is an equivalent circuit diagram of one pixel of an organic light emitting device according to an exemplary embodiment of the present invention.

Referring to FIG. 18, unlike the organic light emitting device that is shown in FIG. 10, the fifth switching transistor Qs5 is connected between a contact point N2 and a pull-down voltage Vpd. The pull-down voltage Vpd is a lower voltage than the sustain voltage Vsus. It is preferable that the pull-down voltage Vpd has a value that is substantially different from the driving voltage Vdd. If the pull-down voltage Vpd that is different from the sustain voltage Vsus is separately connected to the fifth switching transistor Qs5, the driving transistor Qd can be reset to the pull-down voltage Vpd that is lower than the driving voltage Vdd. Therefore, even when the threshold voltage Vth of the driving transistor Qd is high, the threshold voltage Vth can be appropriately compensated.

While this invention has been described in connection with what is presently considered to be practical exemplary embodiments, it is to be understood that the invention is not limited to the disclosed exemplary embodiments, but, on the contrary, is intended to cover various modifications and equivalent arrangements included within the spirit and scope of the appended claims.

What is claimed is:

1. A display device comprising:

a light-emitting element;

a first capacitor that is connected between first and second contact points;

a driving transistor that has an output terminal, an input terminal that is connected to a first voltage, and a control terminal that is connected to a second contact point;

a first switching transistor that is controlled by a first scanning signal and that is connected between a data voltage and the first contact point;

a second switching transistor that is controlled by the first scanning signal and that is connected between a second voltage and the first contact point;

a third switching transistor that is controlled by a second scanning signal and that is connected between the second contact point and the output terminal of the driving transistor;

a fourth switching transistor that is controlled by a third scanning signal and that is connected between the light-emitting element and the output terminal of the driving transistor; and a fifth switching transistor that is controlled by a fourth scanning signal and that is connected between the second voltage and the second contact point, wherein the first, second, third, and fourth scanning signals consist of a high voltage and a low voltage, and periods in which each of the second and fourth scanning signals is a high voltage do not overlap.

2. The display device of claim 1, wherein high voltages of each of the second and fourth scanning signals are sustained for more than half a horizontal period.

3. The display device of claim 1, wherein the high voltage of the first scanning signal is sustained for two horizontal periods.

4. The display device of claim 3, wherein a period in which the first scanning signal is a high voltage overlaps with each of periods in which the second and fourth scanning signals are a high voltage.

5. The display device of claim 4, wherein the high voltage of the fourth scanning signal is sustained for two horizontal periods.

6. The display device of claim 1, wherein a period in which the third scanning signal is a high voltage is longer than a period in which the first, second, and fourth scanning signals are a high voltage.

7. The display device of claim 1, wherein the second voltage has a lower value than the first voltage.

8. The display device of claim 1, wherein the first switching transistor, the third switching transistor, and the fifth switching transistor are each an n-channel electric field effect transistor, and the second switching transistor, the fourth switching transistor, and the driving transistor are each a p-channel electric field effect transistor.

9. A display device comprising:

a light-emitting element;

a first capacitor that is connected between first and second contact points;

a driving transistor that has an output terminal, an input terminal that is connected to a first voltage, and a control terminal that is connected to a second contact point;

a first switching transistor that is controlled by a first scanning signal and that is connected between a data voltage and the first contact point;

a second switching transistor that is controlled by the first scanning signal and that is connected between a second voltage and the first contact point;

a third switching transistor that is controlled by a second scanning signal and that is connected between the second contact point and the output terminal of the driving transistor;

a fourth switching transistor that is controlled by a third scanning signal and that is connected between the light-emitting element and the output terminal of the driving transistor; and a fifth switching transistor that is controlled by a fourth scanning signal and that is connected between the second voltage and the second contact point, wherein a period in which the third scanning signal is a high voltage is longer than a period in which the first, second, and fourth scanning signals are a high voltage.

* * * * *